United States Patent [19]

Hanson et al.

[11] Patent Number: 5,025,859

[45] Date of Patent: Jun. 25, 1991

[54] OVERLAPPING HORIZONTAL FRACTURE FORMATION AND FLOODING PROCESS

[75] Inventors: Merle E. Hanson, Livermore; Lewis D. Thorson, Milpitas, both of Calif.

[73] Assignee: Comdisco Resources, Inc., San Francisco, Calif.

[21] Appl. No.: 504,090

[22] Filed: Apr. 2, 1990

Related U.S. Application Data

[63] Continuation of Ser. No. 331,455, Mar. 31, 1987, abandoned, which is a continuation-in-part of Ser. No. 186,046, Apr. 25, 1988, Pat. No. 4,889,186.

[51] Int. Cl.[5] ..... E21B 43/26; E21B 43/30

[52] U.S. Cl. ..... 166/252; 166/245; 166/271; 166/308

[58] Field of Search ..... 166/308, 271, 259, 245, 166/250, 252

[56] References Cited

U.S. PATENT DOCUMENTS

| | | | |
|---|---|---|---|
| 2,821,255 | 1/1958 | Spearow | 166/271 |
| 2,862,556 | 4/1956 | Tek . | |
| 2,946,382 | 7/1960 | Tek et al. . | |
| 3,073,386 | 1/1963 | Bertuzzi | 166/271 |
| 3,199,586 | 8/1965 | Henderson et al. . | |
| 3,385,362 | 5/1968 | Strange et al. | 166/259 |
| 3,402,769 | 9/1968 | Doggett et al. | 166/254 |
| 3,501,201 | 3/1970 | Closmann et al. . | |
| 3,586,105 | 6/1971 | Johnson et al. | 73/155 |
| 3,682,246 | 8/1972 | Closmann . | |
| 3,810,510 | 5/1974 | Fitch et al. . | |
| 4,005,750 | 2/1977 | Shuck . | |
| 4,044,828 | 8/1977 | Jones et al. . | |
| 4,265,310 | 5/1981 | Britton et al. . | |
| 4,271,696 | 6/1981 | Wood | 73/37 |
| 4,353,244 | 10/1982 | Wood | 73/37 |
| 4,432,078 | 2/1984 | Silverman . | |
| 4,529,036 | 7/1985 | Daneshy et al. . | |
| 4,687,061 | 8/1987 | Uhri . | |
| 4,714,115 | 12/1987 | Uhri . | |

OTHER PUBLICATIONS

Effect of Fracture Azimuth on Production with Application to the Wattenberg Gas Field, SPE 8298, 1979, (7 pages).

Comparison of Hydraulic-Fracture Orientation Techniques, SPE Formation Evaluation, Mar. 1987, vol. 2, No. 1 (pp. 66-76).

Field Measurements of Dynamic Pressure and Seismic Activity During Foam Fracturing, SPE 18555, Nov. 1-4, 1988 Meeting (pp. 361-368).

Overview of Current Hydraulic Fracturing Design and Treatment Technology, JPT, Apr. 1983, Pt. 1 (pp. 677-687), Pt. 2 (pp. 853-864).

The Effect of Vertical Fractures of Well Productivity, JPT, Oct. 1960, (pp. 72-74).

The Borehole Televiewer-A New Logging Concept (List continued on next page.)

*Primary Examiner*—Stephen J. Novosad

*Attorney, Agent, or Firm*—Christie, Parker & Hale

[57] ABSTRACT

In a fluid flood process for enhancing the secondary recovery of hydrocarbons from a hydrocarbon permeable and hydrocarbon bearing reservoir using plural recovery wells, each adjacent at least one injection well. Each well has a well bore. A horizontal injection fracture extends substantially horizontally from the well bore of each of selected injection well bores. A horizontal recovery fracture extends substantially horizontally from the well bore of each of selected recovery wells and is vertically displaced from and overlapping with one or more of the injection fractures of the adjacent injection wells. A pair of overlapping injection and recovery fractures, that would overlap with a low permeable layer in the reservoir, is selectively positioned vertically at one side of such layer in the reservoir. Another pair of overlapping injection and recovery fracture is selectively positioned, with the injection fracture thereof, adjacent at the lower limit and the recovery fracture thereof adjacent at the upper limit of the reservoir at the respective well.

87 Claims, 9 Drawing Sheets

OTHER PUBLICATIONS for Fracture Location and Other Types of Borehole Inspection, Jun. 1969, JPT (pp. 762–774).

"The Street Ranch Pilot Test of Fracture-Assisted Steamflood Technology", SPE 10707, Britton et al., pp. 69–93.

"Effects of Hydraulic Fracturing in Oklahoma Waterflood Wells", John P. Powell, Kenneth H. Johnston; Dept. of Interior Oklahoma; Report of Investigations 5713.

"The Application of Hydraulic Fracturing in the Recovery of Oil by Waterflooding: A Summary"; James A. Wasson; Dept. of Interior; Information Circular 8175.

"Gravity Drainage of Oil Into Large Horizontal Fractures"; Morrisson et al.; Gulf Research & Development Co., Pittsburgh, Pa., vol. 219, 1960.

"Optimizing Program Increases Field's Profits"; Technology; Tom Huebinger et al.; Aug. 29, 1988, Oil & Gas Journal.

"A Comprehensive Fracture Diagnostics Experiment: Part 1-An Overview"; Fitz-Patrick et al.; SPE Production Engineering, Nov. 1986.

"Fracture Optimization in a Tight Gas Play: Muddy J Formation, Wattenberg Field, Colorado", C. N. Roberts, Amoco Production, Co. SPE/DOE 9851; pp. 245–252.

"Effect of Fracture Azimuth on Production with Application to the Wattenberg Gas Field": SPE 8298; Smith, Member SPE-AIME, Amoco Production Co.

"The Azimuth of Deep, Penetrating Fractures in the Wattenberg Field"; Smith et al.; Feb. 1978; Journal of Petroleum Technology.

"Fracture Azimuth-A Shallow Experiment"; Smith et al.; Jun. 1980, vol. 102; Journal of Energy Resources Technology.

'Physical Principles of Oil Production'; Morris Muskat, PhD., International Human Resources Development Corporation, Chapter 12, pp. 645–682, pub. 1981.

"Transactions of the American Institute of Mining and Metallurgical Engineers", vol. 103; Petroleum Development and Technology 1933 Petroleum Division, pp. 219–249.

"Analysis and Implications of Three Fracture Treatments in Coal at the USX Rock Creek Site Near Birmingham, Ala."; Quarterly Report; Jul. 1986 to Oct. 1986; Gas Research Institute.

SELECT FORMATION WITH LOW VERTICAL STRESS COMPONENT HAVING A HYDROCARBON PERMEABLE AND BEARING RESERVOIR.

DETERMINE AZIMUTH OF VERTICAL FRACTURE IN RESERVOIR

FORM INJECTION WELL BORES IN ROWS AND PRODUCTION WELL BORES IN ROWS, EACH ROW PARALLEL WITH THE AZIMUTH AND FORM EACH WELL BORE ALL THE WAY THROUGH THE RESERVOIR.

SCAN RESERVOIR, AT EACH WELL BORE, ALL THE WAY THROUGH THE RESERVOIR, TO LOCATE IN THE RESERVOIR, AT EACH WELL, i) THE UPPER LIMIT AND LOWER LIMIT OF THE RESERVOIR AND ii) ANY LOW PERMEABLE LAYER IN THE RESERVOIR THAT EXTENDS SUBSTANTIALLY CONTINUOUSLY AND HORIZONTALLY INTO OVERLAPPING RELATION WITH THE LOCATION FOR ANY PAIRS OR OVERLAPPING PRODUCTION AND INJECTION FRACTURES.

a) FORM A HORIZONTAL INJECTION FRACTURE FROM INDIVIDUAL INJECTION WELL BORES AND A HORIZONTAL PRODUCTION FRACTURE FROM INDIVIDUAL PRODUCTION WELL BORES OVERLAPPING WITH THE INJECTION FRACTURES, b) SELECTIVELY POSITION PAIRS OF OVERLAPPING INJECTION AND PRODUCTION FRACTURES, THAT WOULD OVERLAP WITH THE LAYER, VERTICALLY AT ONE SIDE OF THE LAYER IN THE RESERVOIR AND c) SELECTIVELY POSITIONING OTHER PAIRS OF OVERLAPPING INJECTION AND PRODUCTION FRACTURES WITH THE INJECTION FRACTURES THEREOF SUBSTANTIALLY AT THE LOWER LIMIT AND THE PRODUCTION FRACTURES THEREOF SUBSTANTIALLY AT THE UPPER LIMIT OF THE RESERVOIR AT THE RESPECTIVE WELL BORE.

FLOOD THE HYDROCARBONS FROM THE INJECTION TO THE OVERLAPPING PRODUCTION FRACTURES

FIG. 6

OVERLAPPING HORIZONTAL FRACTURE FORMATION AND FLOODING PROCESS

CROSS REFERENCE TO RELATED APPLICATION

This application is a continuation of the U.S. patent application Ser. No. 07/331,455, filed Mar. 31, 1989, now abandoned, which in turn, is a continuation in-part of U.S. patent application Ser. No. 186,046, Filed Apr. 25, 1988, now U.S. Pat. No. 4,889,186, the disclosure of which is incorporated herein by reference.

BACKGROUND OF THE INVENTION

1. Field of the Invention

This invention relates to method and apparatus for the production of hydrocarbons from geologic oil-bearing formations, and more particular, method and apparatus for enhancing the secondary recovery of oil from such formations.

2. Brief Description of the Prior Art

Oil has been recovered from geological oil bearing reservoirs through wells in a variety of ways. Where the reservoir contains sufficient pressure the oil may be forced out of the reservoir through a well without assistance. Pumps are also used to lift oil out of a well.

Many times a reservoir does not contain sufficient pressure to force the oil out of the reservoir into the well and secondary recovery techniques are required for recovery. One method widely used is to flood the reservoir from one or more injection wells to drive the oil from the reservoir to adjacent production wells from which the oil is lifted to the surface.

Flooding has been performed with a variety of fluid medium, including surfactants, water at normal temperatures, water at elevated temperatures and steam. Specially prepared fluids have been used to cause the oil to more easily move out of the formation.

Fracturing is a well known technique for enhancing the flow of fluid from injection wells and the flow of fluid from the reservoir into the production wells. Specifically, fluid has been forced through the opening in an injection well into the surrounding geological formation to fracture or open up the surrounding sands. Propping materials, such as sand particles, have been injected into the induced injection fracture to hold the fracture open and allow the fluids to flow more readily to the formation from the injection well. Similarly, fluids have been forced through the openings in a production well into the surrounding formation to fracture or open up the sands. Propping materials, such as sand particles, have been injected into the sands of the induced production fractures to hold the formation open to thereby allow the oil and other fluid in the surrounding formation to flow more easily into the production well.

U.S. Pat. No. 2,862,556 to Tek et al. discloses an example of such water flooding methods using two injection wells and a production well, each well surrounded by a horizontal fracture. The horizontal fracture is induced through and around the injection wells at one level, preferably at a lower level or adjacent the bottom of the formation, whereas horizontal fracture is induced around the production well at a higher level or adjacent the top of the formation. The production fracture overlaps with the injection fractures. A water drive is applied through the lower injection fractures to the upper production fracture so as to lift the oil to the upper fracture. Tek points out that the direction of the drive may be reversed. Another U.S. Pat. No. 2,946,382 to Tek et al discloses flooding between multiple horizontal overlapping injection and production fractures, using such media as hot combustible gas, hot water, super heated steam and other hot fluids.

U.S. Pat. No. 3,199,586 to Henderson et al discloses a method for increasing the amount of oil recovered in a water flood, between a large horizontally extending injection fracture and a large extending production fracture of the type disclosed in the Tek patents. The injection and production well bores are shown drilled and cored all the way through the oil bearing formation. The fractures are propped open with a propping agent to form fractures of high flow capacity. Henderson discloses the use of water containing a surfactant to help flood the oil from the surrounding formation more easily.

Henderson also discloses a line of injection wells and a line of vertical injection fractures, one in communication with each injection well. Spaced away in a somewhat parallel pattern is a line of production wells and a line of vertical production fractures, one in communication with each production well. Fluid injected into the injection wells flows out into the vertically extending injection fractures, then across the formation into the vertical production fractures.

Although Henderson does not disclose a fully laid out pattern of horizontal production and injection wells, he does refer to the conventional five spot flood or well patterns in connection with the vertical fracture arrangement of FIG. 3 and in connection with flood rates and injection pressures for ordinary well spacings.

U.S. Pat. No. 4,265,310 to Britton discloses a fracture preheat oil recovery process.

An article entitled *Gravity Drainage of Oil Into Large Horizontal Fractures*, by T. E. Morrisson, James H. Henderson, published in Trans of AIME VOL., 219, pages 2–15 (1960), discusses the production of oil through horizontal extending fractures of high capacity and large radius placed at the base of producing formations. Gravity drains the fluid into the producer fracture, and hence into the production well from which the fluid is lifted to the surface. This technique is satisfactory where the oil is of low viscosity for ease of flow, but has drawbacks where the oil has higher viscosities and the formation is thin. Additionally, the recovery rate is slow since fluid flow depends principally on the flow of gravity.

Other articles have been written relating to hydraulic fracturing for the recovery of oil. For example, note the article entitled *Application of Hydraulic Fracturing in the Recovery of Oil by Water Flooding: A Summary*, by James Wasson, published by the Bureau of Mines Information Circular, 8175 (1963), the article *Effects of Hydraulic Fractures in Oklahoma Water Flood Wells*, by John P. Powell & Kenneth H. Johnson, published by the Bureau of Mines Information Circular, 5713 (1960), and the article *The Street Ranch Pilot Test of Fracture-Assisted Steam Flood Technology*, by Britton, Martin, Lebricht and Harmon, presented at the 1982 meeting of the SPE.

The Tek and Henderson methods disclosed above using horizontal overlapping production and injection fractures at, respectfully, the top and bottom of the well, apparently have not been commercially successful.

SUMMARY OF THE INVENTION

The present invention is directed to overlapping horizontal fracture formation and flooding, which significantly enhances the reliability of achieving successful producing oil wells, using secondary recovery techniques. The invention also enhances the oil volume recovery from geological formations, with substantially enhanced reliability.

An embodiment of the present invention is in a flooding process for enhancing the secondary recovery of hydrocarbons from a hydrocarbon permeable and hydrocarbon bearing reservoir using recovery wells one or more injection wells, each well comprising a well bore, and wherein there is (i) a horizontal injection fracture extending substantially horizontally from each of individual such injection well bores and (ii) a horizontal recovery fracture extending substantially horizontally from each of individual such recovery well bores and vertically displaced from an adjacent injection well between which a fluid flood is passed, each such recovery fracture and an adjacent injection fracture forming an adjacent pair, the improvement comprising the steps of: a) scanning substantially all the way through the reservoir at each of said recovery wells and at each of said injection wells and locating, at each such well, i) an upper limit and a lower limit of the reservoir, and ii) any low permeable layer in the reservoir that would extend substantially continuously and horizontally into overlapping relation with the position for at least one fracture of more than one pair of recovery and injection fractures so as to substantially impede the flow of such a fluid flood through such layer and into or out of any fracture overlapping therewith, b) selectively positioning a pair of adjacent injection and recovery fractures, in which at least one fracture thereof would overlap with any such layer, vertically at one side of such layer in the reservoir, and c) selectively positioning another such pair of adjacent injection and recovery fractures with the one fracture thereof adjacent the lower limit and the other fracture thereof adjacent the upper limit of the reservoir at the respective well so as to enable the recovery of hydrocarbons to be maximized in the reservoir during such fluid flood between adjacent injection and recovery fractures.

One embodiment of the invention is in a fluid flood process for enhancing the secondary recovery of hydrocarbons from a hydrocarbon permeable and hydrocarbon bearing reservoir using plural recovery wells, each adjacent at least one injection well. Each well has a well bore. A horizontal injection fracture extends substantially horizontally from the well bore of each of selected injection well bores. A horizontal recovery fracture extends substantially horizontally from the well bore of each of selected recovery wells and is vertically displaced from and overlapping with one or more of the injection fractures of the adjacent injection wells. Each injection fracture and an overlapping recovery fracture forms an overlapping pair of fractures. The reservoir is scanned substantially all the way through the reservoir at each recovery well and at each injection well to locate, at each such well, i) an upper limit and a lower limit of the reservoir, and ii) any low permeable layer in the reservoir that would extend substantially continuously and horizontally into overlapping relation with the position for more than one pair of overlapping recovery and injection fractures so as to substantially impede the flow of a fluid flood through such layer between any such overlapping fractures. A pair of overlapping injection and recovery fractures, that would overlap with any such layer, is selectively positioned vertically at one side of such layer in the reservoir. Another pair of overlapping injection and recovery fracture is selectively positioned, with the injection fracture thereof, adjacent at the lower limit and the recovery fracture thereof adjacent at the upper limit of the reservoir at the respective well so as to enable the recovery of hydrocarbons to be maximized in the reservoir during such fluid flood between overlapping injection and recovery fractures.

A further embodiment of the present invention is in a fluid flood process for enhancing the secondary recovery of hydrocarbons from a reservoir using fluid injection wells and hydrocarbon recovery wells, each well having a well bore, including the steps of (i) establishing a horizontal injection fracture extending substantially horizontally from each plural injection well bores in said reservoir and; (ii) establishing a horizontal recovery fracture, in said reservoir, extending substantially horizontally from each of plural recovery well bores and vertically displaced from at least one injection fracture of an adjacent injection well bore, the improvement comprising the steps of determining the azimuth of a vertical component of a fracture for said reservoir, and disposing said recovery wells in at least one row which is substantially parallel with said azimuth.

Another embodiment of this invention is also in a fluid flood process for enhancing the secondary recovery of hydrocarbons from a reservoir involving fluid injection wells and hydrocarbon recovery wells, each well having a well bore. A horizontal injection fracture is established extending substantially horizontally from the injection well bore in the reservoir. A horizontal recovery fracture for each said recovery well is established extending substantially horizontally from the respective recovery well bore and which is vertically displaced above and overlapping with at least one of the injection fractures in the reservoir. The azimuth of a vertical component of a fracture for the reservoir is determined and the recovery wells are disposed in at least one row which is substantially parallel with the azimuth.

Preferably, a row of recovery wells are disposed between and offset from two adjacent rows of injection wells. Preferably, the rows of injection wells are substantially parallel with the azimuth. Also, preferably, the recovery well bores in each row of recovery wells are positioned between the injection well bores in the rows on each side.

By determining the azimuth of the elongation of the vertical component, the recovery wells can thus be formed and limited in size during formation so as not to intersect and provide an undesirable direct path for the fluid flood from the injection fracture to the recovery fractures.

Preferably, the horizontal extent of the injection and recovery fractures maximize the overlap in the reservoir zone therebetween.

BRIEF DESCRIPTION OF THE DRAWINGS

FIG. 6 is a flow diagram depicting the process for forming horizontal fracture for fluid flood and embodies an alternate embodiment of the present invention.

DETAILED DESCRIPTION

Figure 4:
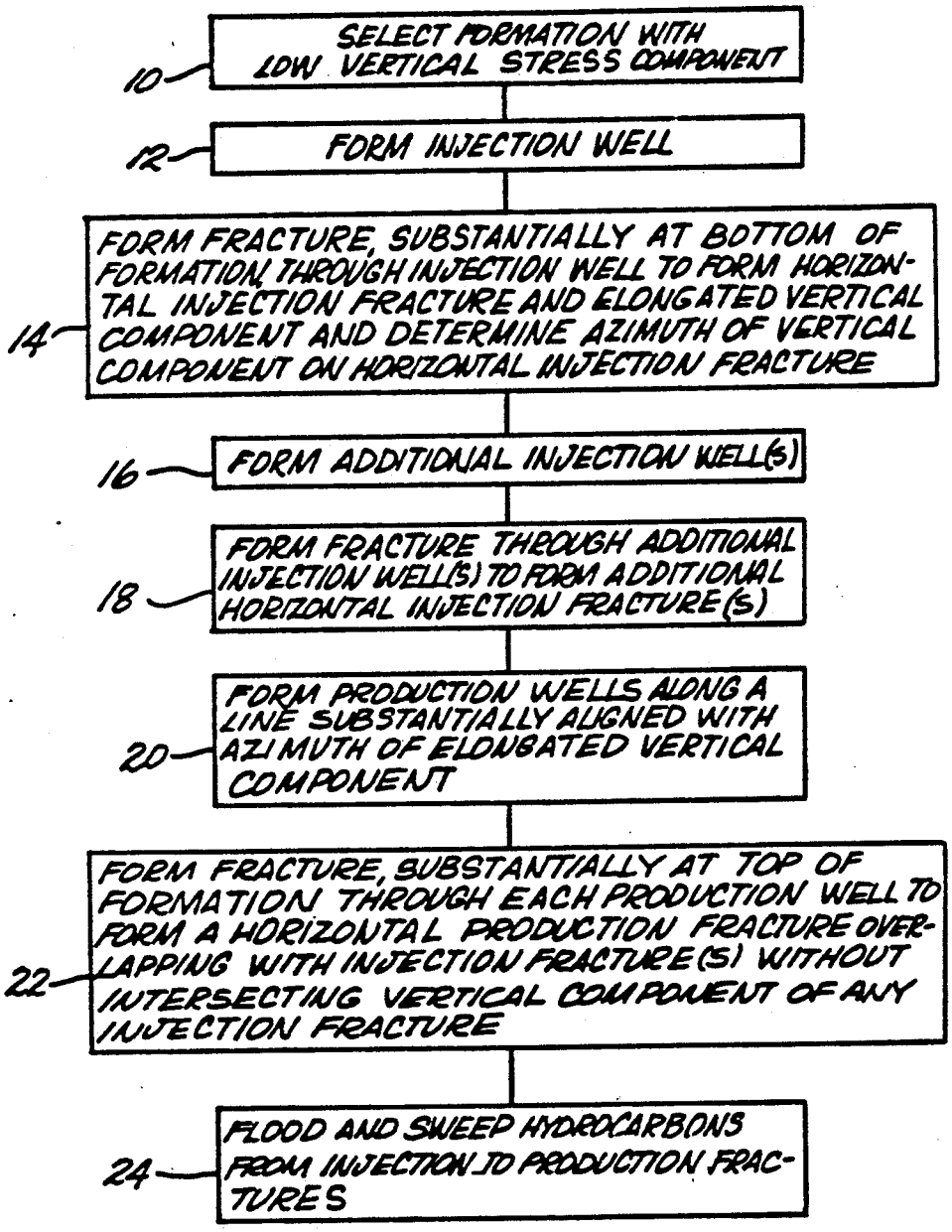
FIG. 4 is a flow diagram depicting the process for forming the horizontal overlapping fractures for fluid flooding and embodies the present invention.

Refer now to the figures and the disclosed waterflood process embodying the present invention. Blocks 10–24 of FIG. 4 depict a sequence of steps of the process, according to the present invention. Initially, a geological formation 28 is selected having a shallow geological hydrocarbon, preferably oil, bearing reservoir 29 that has a ratio of vertical to horizontal stress components of less than 1 (Block 10). The reservoir should also have at least 10 vertical feet and preferably 15 up to about 50 vertical feet or more between bottom 29*a* and top 29*b* extremities of the reservoir, without continuous low permeable streaks, that would block or impair the flow of fluid through the reservoir between horizontal injection and production fractures discussed below. The porosity, oil saturation and absence of continuous low permeable streaks of the formation will determine the acceptable thickness. In the absence of a continuous low permeable streak across the entire reservoir, the greater the porosity and/or the greater the oil saturation, the smaller the acceptable thickness of the reservoir.

Shallow reservoirs, defined herein as those having ratios of vertical to horizontal stress components of less than 1, are typically those located in shallow geological formations and permit the formation of horizontal fractures, as opposed to vertical fractures. Shallow reservoirs are typically at depths of more than about 100 feet and less than about 1200 feet below the surface of the earth. The lower surface of a shallow reservoir may be lower or higher under certain tectonic conditions.

An injection well 30 is then formed, from the surface of the earth through the shallow reservoir 29 by drilling a well bore and casing the well bore with casing 36 clear through the oil bearing reservoir (Block 12). Subsequently, a fracture fluid 32 is applied under high pressure, substantially at the lower surface or bottom 29*a* of the reservoir 29, through an opening 34 that extends transversely through casing 36 in injection well 30. Preferably, where the well spacing is 2 ½ acres per well, 60,000 to 70,000 gallons of fracture fluid are injected, thereby forming a large horizontal injection fracture 38 at the lower portion, preferably substantially at the bottom 29*a* of the reservoir 29. A horizontal fracture is one which is induced by injecting a fluid, such as water, or a water based gel, through a well and which propagates in a substantially horizontal direction from the well, covering a large horizontal surface area as compared to its vertical cross-sectional area.

When forming the horizontal injection fracture, a horizontally elongated vertical component 40 may be formed upward from the top of the horizontal injection fracture because of the stress conditions in the reservoir and the fracture fluid parameters and the way the fracture is applied. The horizontal and vertical fractures are each a very thin crack having an opening between two opposite faces. The size of the opening between the large opposite faces of the horizontal fracture is generally in the order of 0.05 inches and 0.2 inches and the size of the opening between the large opposite faces of the vertical component is generally smaller. One reason that the opening is so small for both is because the sands of the reservoir are consolidated and exhibit competent rock characteristics..

Figure 1:
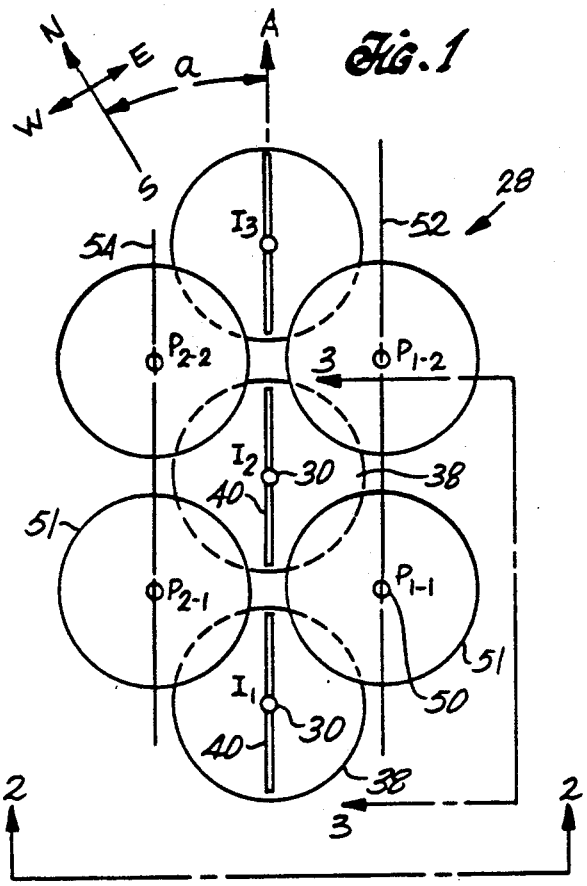
FIG. 1 is an aerial schematic representation of overlapping horizontal fractures in a geological formation for use in water flooding and embodying the present invention.
Figure 2:
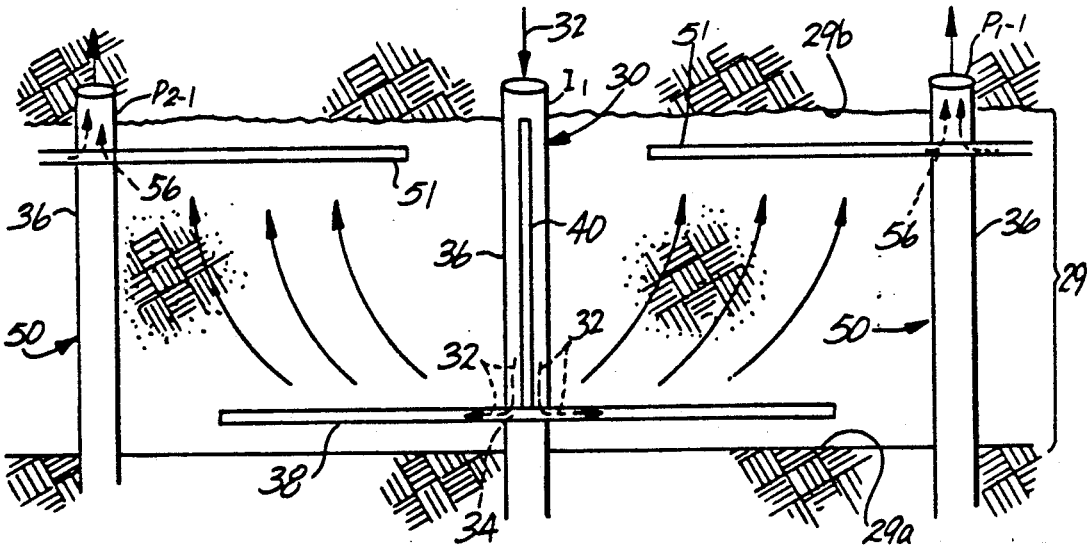
FIG. 2 is a cross-sectional view of the geological formation depicted in FIG. 1, along the Lines 2—2, depicting injection well Il, and the corresponding horizontal injection fracture and production wells P2-1 and Pl-1 and corresponding horizontal production fractures.

The vertical component is aligned parallel with and extends out in opposite directions from the bore of well 30 and along azimuth line "A", as can be seen in FIGS. 1 and 2. The horizontal injection fracture is generally disc shaped and the vertical component may extend vertically from the top of the disc shape up to, in some cases, close to the top 29*b* of the reservoir 29.

Methods and apparatus are well known, in the art, for forming such fractures, see for example, the discussion in the article entitled "Hydraulic Fracturing", SPE-AIME Monograph Vol. 2, Dallas, 1970, by Howard, G. C. and Fast, C. R. the disclosure of which is incorporated by reference herein. Briefly, the horizontal injection fracture is formed by applying fluid through the injection well bore, causing the formation to open or fracture. Propping materials are slurried or mixed into the fracture fluid being passed into the fracture under pressure. As a result, the propping material enters the fracture. After fluid pressure is removed, the propping material props open the fracture to the distance to which the proppent has been carried. The propped horizontal fracture allows fluid pressure, applied in the well during the fluid flood, to extend out horizontally substantially over the propped portion of the horizontal fracture and, therefore, the pressure to be applied over the propped portion of the horizontal surface area of the fracture The opening 34 is preferably formed by cutting a ring through the casing 36 leaving about a 2 inch, and preferably a ½ to 1 inch ring shaped gap in the casing. This technique is sometimes called notching. One process for forming the opening is a jetting process such as that disclosed is JPT May 1961, p. 489, JPT May 1961, p. 483 and SPE June 1963 p. 101, the disclosure of which is incorporated herein by reference. One may also create entries through holes or slots in the casing.

Preferred results have been obtained from fracturing by using between 80,000 and 90,000 pounds of sand in the fracture fluid as a propping material in a 2½ acre per well spacing. Substantially enhanced results have been achieved using number 12/20 mesh sand or larger as compared with smaller size sand. However, in general, larger size sand should be used because that results in higher conductivity in the fracture. If the well spacing is increased or decreased, the amount of sand and fracture fluid is, respectfully, increased or decreased.

The vertical component is caused along the horizontal azimuth because it is parallel to the maximum horizontal stress component of the reservoir formation The location and azimuth "A" of the vertical component is quite important in forming and locating the production fractures, as will be explained.

Also, at Block 14, the azimuth of the vertical component 40 is determined. The preferred method for determining the azimuth of the vertical component on a horizontal fracture is to set an array of 8 to 12 biaxial tilt meters, each at a different location, on the surface of the earth in a circle around the well while the fracture is being formed to monitor the tilt of the surface of the earth at each location. By monitoring and processing the deformation of the earth's surface caused by the fracture, using tilt meters, the azimuth or strike of the vertical component of the fracture may be accurately determined. Processes for use of tilt meters to determine the presence of a vertical component and its azimuth or strike is disclosed at pages 1 to 9 of *Analysis and Implications of Three Fracture Treatments in Coal at the USX Rock Creek Site Near Birmingham, Ala.*, Quarterly Report, July 1986 to October 1986, by the Gas Research Institute, the content of which is incorporated herein by reference.

A preferred shallow reservoir, that is selected, is one where there are substantially continuous, highly permeable sands, from top to bottom in the reservoir, from which the hydrocarbons can be extracted using a fluid flood. Various techniques exist for determining the top and bottom of the reservoir. By way of example, the geological formation can be cored, through the reservoir, during drilling the injection well. Preferably the drilling is extended clear through the reservoir while coring and subsequently the reservoir is logged. By analyzing the core samplings, and the logs, using techniques well known in the art, one can determine the transition to the highly permeable sands in the reservoir from the tight sands, where no movable oil exists. This transition occurs at the top **29*b* of the well. By monitoring the core samples and logs, one can also determine the transition from the highly permeable sands in the reservoir back to the tight sands, where no movable oil exists, or through which the flooding fluid cannot propagate below the bottom 29*a*** of the reservoir Similar techniques of coring and logging are used for the production wells as discussed hereinafter.

At Block 16 of FIG. 4, additional injection wells 30 are formed, preferably along the azimuth "A" of the vertical component 40 of the first horizontal injection fracture The first well is indicated by the symbol Il, whereas additional wells are indicated, by way of example, by the symbols 12 and 13. Each injection well is substantially the same as and is formed in substantially the same way as well Il.

At Block 18, additional large horizontal injection fractures 38 are formed through each of injection wells 12 and 13, substantially the same as and in substantially the same way as for well Il. The additional fractures are large substantially horizontal fractures and each may have a vertical component 40, extending in the direction of the azimuth "A". If desired, the azimuth "A" of the elongated vertical component can be determined for each horizontal fracture using tilt meter techniques discussed above. However, this is not normally necessary, as the azimuth can be predicted from the azimuth of the vertical component of the first horizontal fracture in the reservoir. Prediction of the azimuth of the vertical component, for each subsequent fracture, can be predicted without use of additional tilt meter tests, if the geological formation is known to be tectonically similar and the azimuth of the vertical component of a previously formed horizontal fracture has been determined.

Recovery or production wells 50 are each formed, by drilling a bore hole and putting a casing 36 in the bore hole, extending from the surface of the earth into the reservoir 29. By way of example, four production wells 50 are indicated at Pl-1, pl-2, p2-1 and P2-2. The wells Pl-1 and Pl-2 are aligned along a line 52, displaced from, but substantially parallel with the azimuth "A" of the elongated vertical component of each of the injection wells 30. Similarly, each of the production wells P2-1 and P2-2 are aligned along a line 54, which is displaced from, but substantially parallel with the azimuth "A".

At Block 22, a fracture is formed in reservoir 29, at the upper portion adjacent substantially at the top or upper surface **29*b* of the reservoir, through an opening 56 in the casing 36, of each of production wells 50 The horizontal production fracture formed around each production well, is a large substantially horizontal fracture which has a similar shape to and is formed in a similar manner to and using similar techniques to that discussed above for the horizontal injection fractures Typically, the production fractures are made slightly smaller than the injection fractures by applying or inducing, preferably 35,000 to 38,000 gallons of fracture fluid and preferably 50,000 to 60,000 pounds of substantially the same size sand as used for the injector well with the 2½ acre spacing. The production fractures extend horizontally out over and overlap adjacent horizontal injection fractures as illustrated in FIG. 1**. It is believed that even larger injection and production fractures using larger amounts of fracture fluid may be used.

Figure 3:
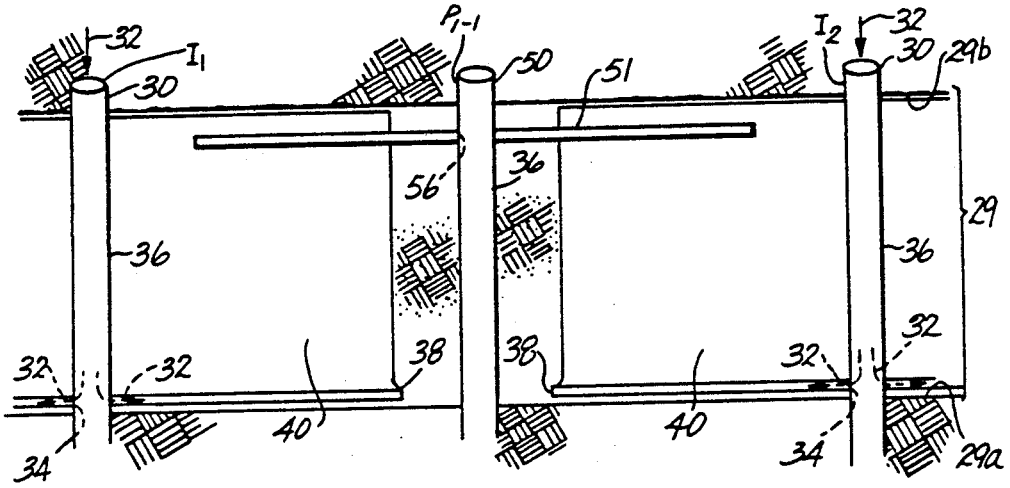
FIG. 3 is a cross-sectional view of the geological formation depicted in FIG. 1, along the Lines 3—3, depicting injection wells I1 and I2 with corresponding horizontal injection fractures and production well Pl-1 with the corresponding horizontal production fracture, but removing production well Pl-2 and its corresponding horizontal production fracture.

The vertical component of the horizontal injection fracture will extend from the horizontal injection fracture to the top **29*b* of the reservoir as illustrated in Figs. 2 and 3** and, therefore, above a horizontal plane intersecting the production fracture. Therefore, the diameter of the horizontal fractures are limited in size and the production wells are aligned with the azimuth "A", to prevent the production fractures and vertical components from intersecting and short circuiting, and thereby preventing proper flow of fluid between injection and production fractures through the reservoir during water flooding.

The injection and production fractures are typically designed, using a theoretical model, before they are formed. In the case of the production fractures, these fractures are designed ahead of time so that, as discussed above, they do not extend out far enough to intersect a plane passing through the injection well bores parallel with the azimuth of the vertical components of the horizontal injection fractures Techniques for the design, including sizing of fractures, are well known in the art and need not be discussed in detail. However, one technique that may be employed for designing and sizing a production fracture so that it does not intersect the azimuth of the vertical component of the horizontal fracture is outlined by way of example Specifically, one may determine the thickness or vertical dimension of the fracture by knowing the rock properties in the reservoir and the properties of the fracturing fluid in which the horizontal production fracture is to be formed. Knowing the approximate thickness that will be formed in the production fracture and knowing that the fracture would be generally disk shaped, a maximum radius is assigned to the production fracture beyond which the fracture should not go so as to avoid intersecting the azimuth of the vertical components of the injection fractures. Knowing the maximum radius and the thickness, the maximum permissible volume of the fracture and the amount of fluid that will leak into the formation from the fracture during the fracturing process, maximum volume of the fracture fluid is then computed. The volume of the production fracture will be changed depending on various additional factors. For example, if the well is close to the proximity of a reservoir boundary, the size and therefore volume of the production fracture is reduced to avoid running into the boundary If the production fracture runs into the boundary of the reservoir, it is possible that the fracture will grow away from the edge and may intersect another fracture The sequence of steps and, therefore, the design of typical large production and injection fractures, for well spacing of 2½ acres per well, is as follows

LARGE PRODUCTION FRACTURE

Introduce as fracture fluid slurries the following in sequence:

12000 gal. of gelled water (pad)
2000 gal. of 1 ppg. 20/40 frac sand
2000 gal. of 1 ppg. 12/20 frac sand
5500 gal. of 2 ppg. 12/20 frac sand
14000 gal. of 3 ppg. 12/20 frac sand
1200 gal. gelled water (flush)
(Total:
36700 gal. of gelled water
2000 lb. of 20/40 frac sand
55000 lb. of 12/20 frac sand)

LARGE INJECTION FRACTURE

Introduce as fracture fluid slurries the following in sequence:

23000 gal. of gelled water (pad)
3000 gal. of 1 ppg. 20/40 frac sand
2000 gal. of 1 ppg. 12/20 frac sand
5000 gal. of 2 ppg. 12/20 frac sand
22000 gal. of 3 ppg. 12/20 frac sand
1200 gal. gelled water (flush)
(Total:
56200 gal. of gelled water
3000 lb. of 20/40 frac sand
78000 lb. of 12/20 frac sand)

Where ppg is pounds of sand per gallon of gelled water and the gelled water is a mixture of water and a vegetable guar, mixed 40 pounds of guar per 1000 gallons of water. However, different amounts of guar may be used. The guar is a well known vegetable substance used to thicken fluid.

It is possible to drive the vertical component of injection fractures a great distance with little fluid. The vertical growth of the vertical component has been successfully controlled in certain applications by adding sand about half-way through the introduction of the gel pad.

Figure 5:
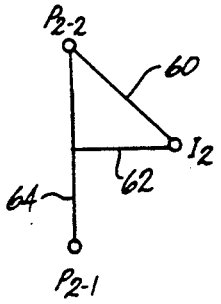
FIG. 5 is a schematic elevation view depicting the horizontal spacing between injection and production wells.

One application is depicted in FIG. 5 where the injection wells are spaced between production wells in a 2½ acre per well spacing and the preferred distance 60 from an injection well and the closest two production wells is about 330 feet. However, assuming the distance 62 between an injection well and a line 64 along the closest row of production wells P2-1 and P2-2 is about 283 feet. Preferably, the radius of the injection fractures are each about 265 to 285 feet and the radius of each of the production fractures are about 235 to 250 Therefore, preferably the ratio of the radius of any production (or recovery) fracture to the radius of any injection fracture is about 235 tp 250 divided by 265 to 285 feet. Where the well spacing is smaller or greater, the dimensions are decreasd or increased proportionally.

When all of the desired injection and production wells are in place and the corresponding horizontal and horizontal production fractures formed, production is commenced.

At Block 24, a flood is applied through the well bore of each injection well 30, out through the horizontal injection fractures. This pressurized fluid forms a pressure gradient between each horizontal injection fracture and the overlapping horizontal production fracture or fractures, causing the fluid to sweep the hydrocarbons upward from the horizontal injection fractures into the overlapping horizontal production fractures, and then into the well bores of the production well out through the production wells to surface equipment where the hydrocarbons and water are retrieved and separated. The fluid may contain surfactants and hot water or cold water, depending on the application.

Enhanced results have been achieved by pumping the fluid entering the production wells, keeping the level of fluid in the production wells pumped down as close as possible to the production fracture The casings of the injection and production wells are typically 5½ inches in diameter. In some cases, the production casings will have to be of a larger diameter to satisfy equipment requirements.

Consider now the alternate embodiment of the invention as depicted in FIGS. 6–14. FIG. 6 depicts a process for enhancing the secondary recovery of hydrocarbons from a hydrocarbon permeable and bearing reservoir and involves steps 150 through 159.

Figure 7:
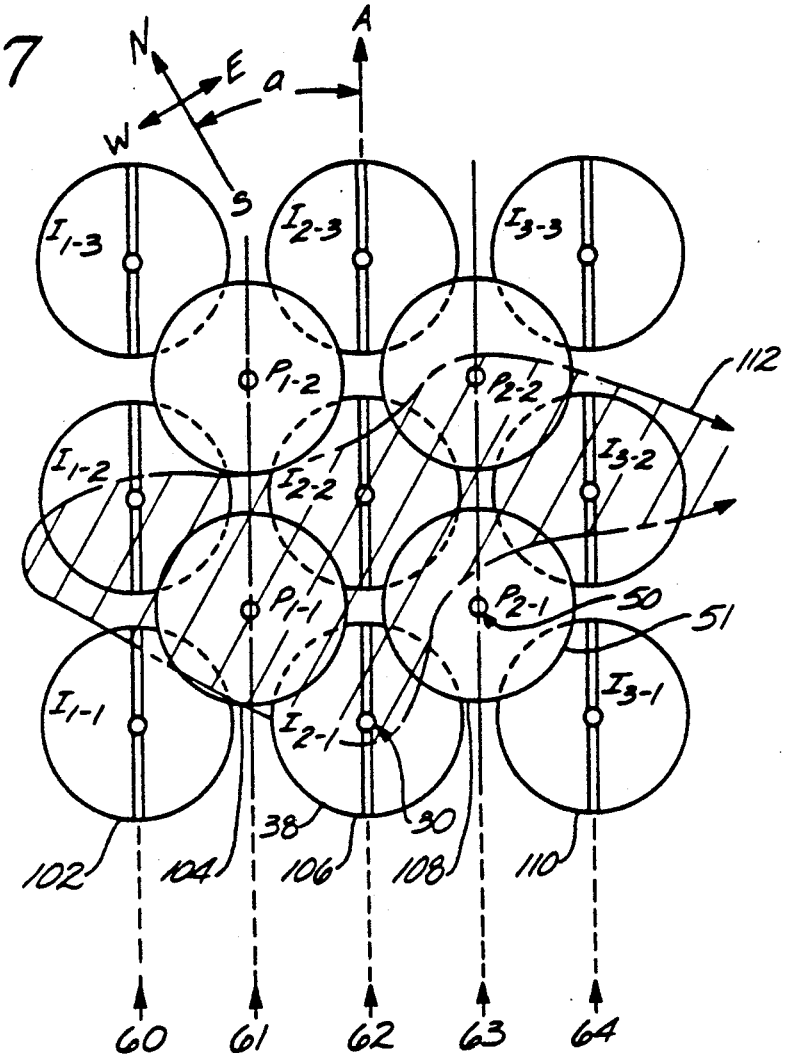
FIGS. 7, 9 and 11 are schematic representations of various overlapping horizontal fractures, with production fractures between two rows of injection fractures, and embodying the present invention.
Figure 8:
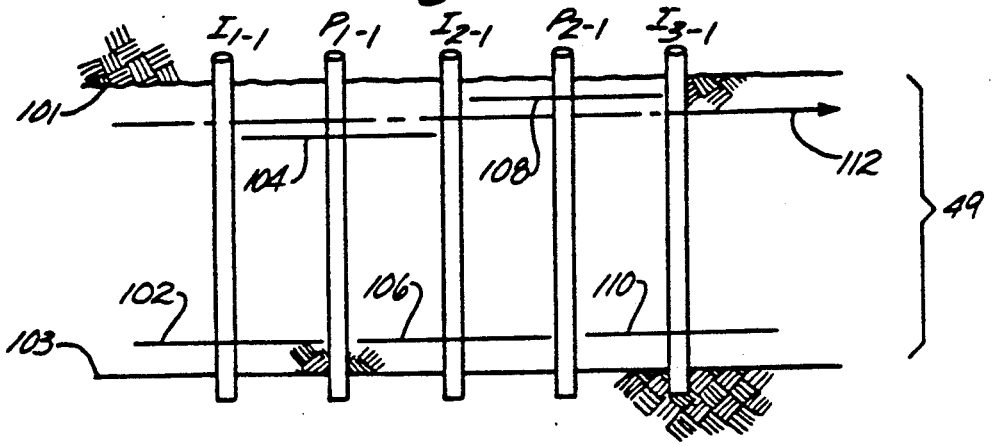
FIGS. 8, 10 an 12 are cross-sectional views of the geographical formations of FIGS. 7, 9 and 11.

Referring to FIGS. 6, 7 and 8 consider the process.

During block 150, the process involves selecting a reservoir having a low vertical stress component, as compared with the horizontal stress component thereof, that is hydrocarbon permeable and hydrocarbon bearing. Such a reservoir is depicted at 49 in FIG. 8. The criteria and parameters involved in selection are essentially the same as that described above in connection with FIGS. 1–4.

During block 152, the process involves the determination of the azimuth of a vertical fracture in the reservoir. The method involved is the same as that described above, with reference to FIGS. 1–4 where an injection fracture is formed from the well bore, for example, of injection well I2-1 and the azimuth A of a vertical component 40 on that horizontal injection fracture is determined.

During block 154, the process involves forming injection well bores 30, for each of injection wells I, in rows 60, 62 and 64 of FIG. 8. Also, production well bores are formed, for each of production wells P, in rows 61 and 63. Each row of well bores (and wells) is parallel with the azimuth A and each well bore is formed all the way through the reservoir 49 as depicted in FIG. 8.

During block 156, the process involves scanning the reservoir, at each well bore (and well), all the way through the reservoir, to locate in the reservoir, at each well, the top or upper limit 101 and the bottom or lower limit 103 of the reservoir. As discussed above, the reservoir is normally located between hard impermeable sands above the top or upper limit 101 and below the bottom or lower limit 103 of the formation.

In addition, the step of scanning involves locating any low permeable layer 112 (or layers) in the reservoir that extends substantially continuously and horizontally into overlapping relation with the location for any pairs of overlapping production and injection fractures. By way of example, in FIGS. 7 and 8, impermeable layer 112 is located during scanning of wells Il-2, Pl-1, I2-1, I2-2, P2-2 and I3-2. It is also determined that the layer 112, most likely, extends in overlapping relation with the fractures for wells Il-2, Pl-1, pl-2, 12-1, 12-2, p2-1, p2-2 and I3-2 and is located close to the upper limit 101 of the reservoir. Accordingly, considering all of the "characteristics of the reservoir" (to be discussed hereafter) determined while scanning all the way through the reservoir at each well, it was decided that the best way to maximize the recovery of hydrocarbons is to locate the production fracture 104 of well Pl-1 on the same side (i.e., the lower side) of the layer 112 where the overlapping injection fractures 102 and 106, of wells Il-1 and I2-1, are located. As a result, overlapping injection and production fracture pairs 102–104 and 106–104 are formed. Production fracture 108, of well P2-1, is likely blocked from the injection fracture of injection wells I2-2 and I3-2, but is only partially blocked from the injection fractures 106 and 110, by impermeable layer 112. It was decided, based on the "characteristics of the reservoir" determined while scanning all the way through the reservoir at the wells, that maximum recovery of hydrocarbons can be obtained by locating the production fracture 108, of well P2-1, above the impermeable layer 112 because of the substantial overlap that it has with injection fracture 106, of well Il-1, and the unblocked overlap with injection fracture 110, of well I3-1, thereby forming overlapping injections and production fracture pairs 106–108 and 110–118. Injection fractures 102, 106 and 110 are all located as low as possible adjacent or substantially at the lower limit, 103, of the reservoir 49 to maximize the sweep from the fractures through the reservoir.

Figure 9:
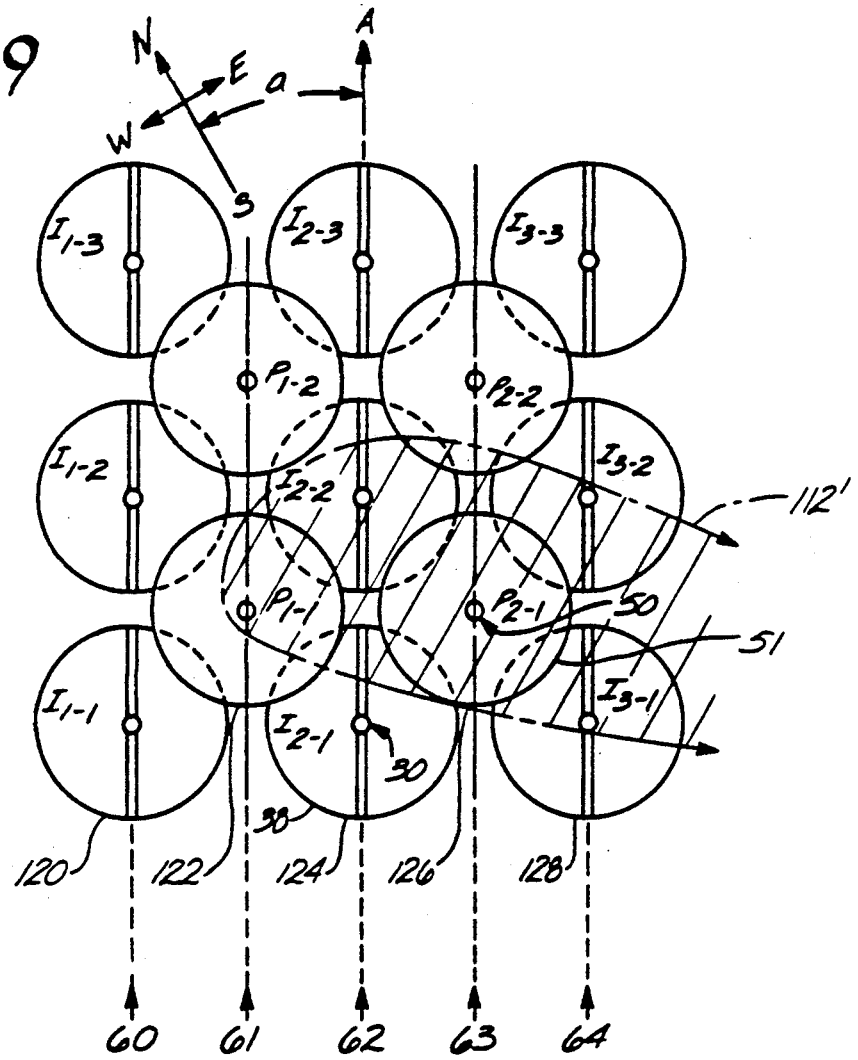
Figure 10:
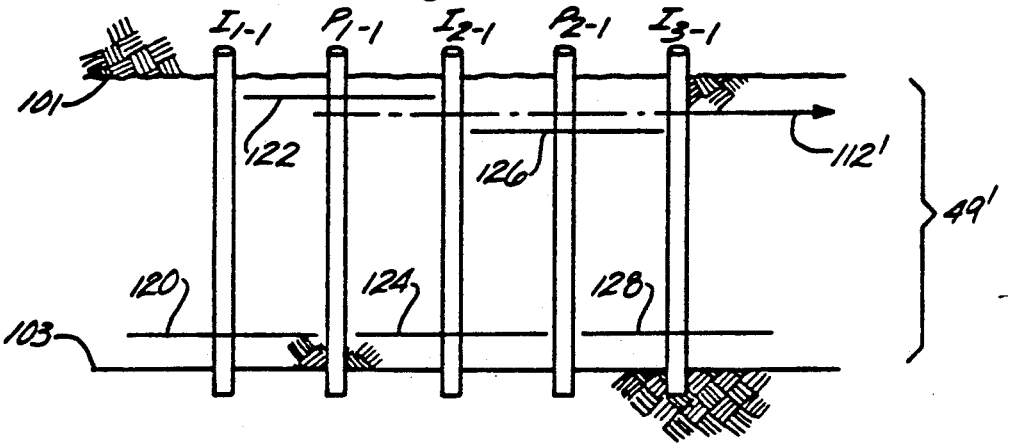

By way of further example, in FIGS. 9 and 10, an impermeable layer 112' is detected while scanning all the way through the wells Pl-1, I2-1, I2-2, P2-1, I3-1 and I3-2. Based thereon, it is determined that the layer 112' most likely overlaps with the fractures of wells Pl-1, I2-1, I2-2, P2-1, P2-2, I3-1 and I3-2. Accordingly, considering all of the "characteristics of the reservoir" determined during scanning clear through the reservoir at the wells, it was decided that the best way to maximize the recovery of hydrocarbons in reservoir 49' is to position the production fracture 122', of well Pl-1, above the layer 112, because of the large sweep from the injection fractures of wells Il-1, 11-2 and 12-1, to thereby form overlapping injection and production fracture pairs with wells Il-1, Il-2 and I2-1; to locate production fracture 126' below and on the same side of layer 112' with the injection fractures of wells I2-1, I2-2, I3-1 and I3-2 to form overlapping injection and production fracture pairs 124-126 and 128-126 and injection and additional production fracture pairs with wells I2-2 and I3-2.

Figure 11:
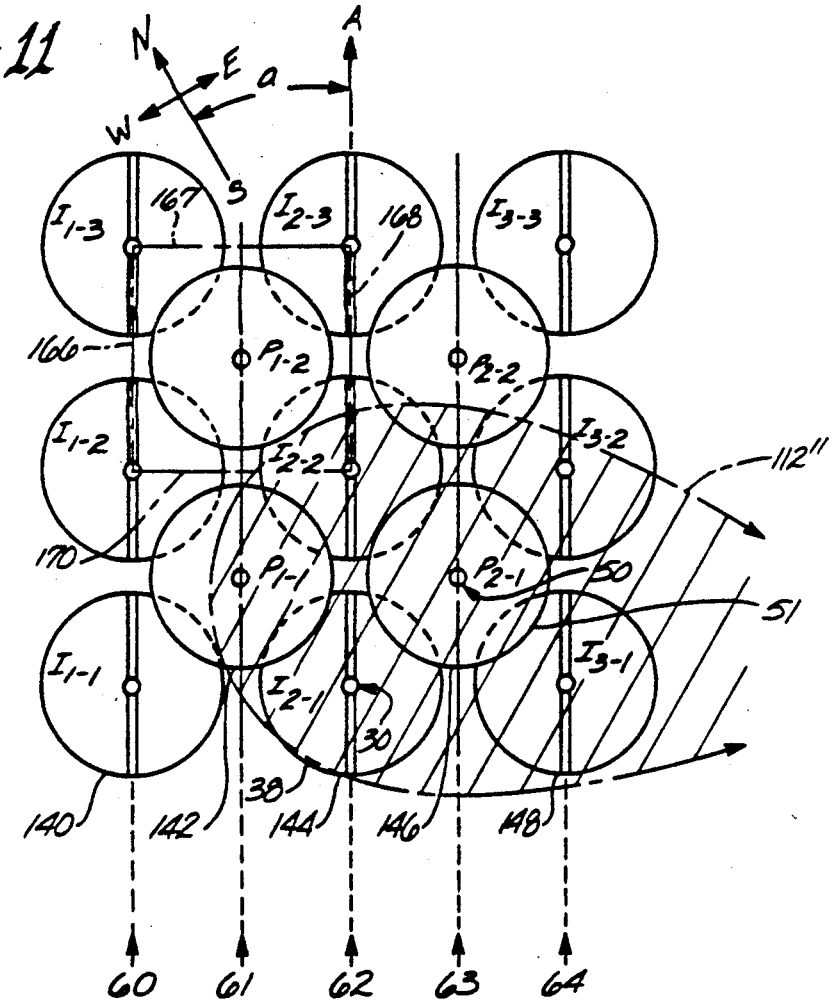
Figure 12:
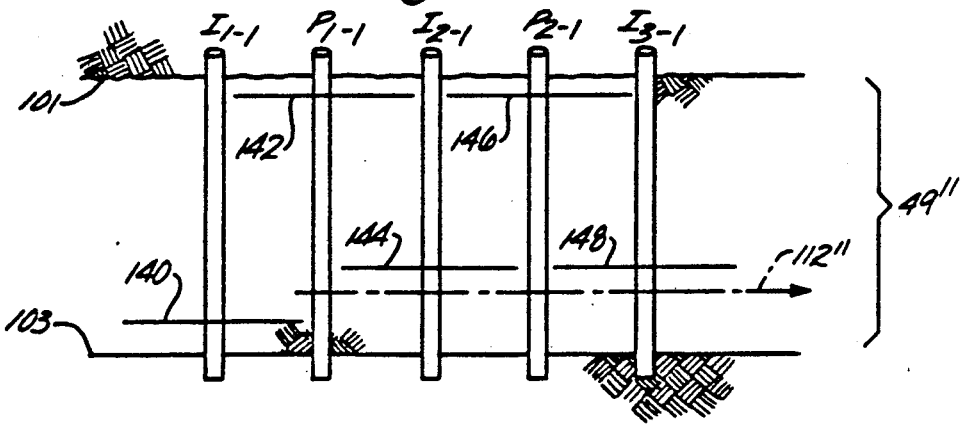

Also, by way of example, in FIGS. 11 and 12, impermeable layer 112" is detected while scanning all the way through wells P2-1, I2-1, I2-2, P2-1, I3-1 and I3-2. It is determined that the layer 112" most likely is continuous and overlaps with the fractures of wells P2-1, I2-1, I2-2, P2-1, I3-1 and I3-2 and is located towards the lower part of reservoir 49". Accordingly, considering all of the characteristics of the reservoir determined while scanning all the way through the wells, it was decided that the best way to maximize the recovery of hydrocarbons in reservoir 49" is to position the injection fracture of well Il-1 substantially at the lower limit 103 of the reservoir 49"; to position the injection fractures for wells I2-1 and I3-1 above and on the same side of layer 112" as the production fractures of wells P1-1 and p2-1, primarily because the layer 112" substantially overlaps the entire injection fracture 144 and 148 of wells I2-1 and I3-1, and to locate the production fracture 142 and 146 for wells P1-1 and P2-1 substantially at the upper limit 101 of the reservoir 49". As a result, there are formed overlapping injection and production fracture pairs 140–142 of wells Il-1 and P2-1, 144–142 of wells I2-1 and Pl-1, 144-146 of wells I2-1 and P2-1 and 148–146 of wells I3-1 and P2-1.

The way in which the scanning is performed and the various "characteristics of the reservoir" considered will be discussed in more detail hereafter.

Returning to the flow diagram of FIG. 6, during block 158, the process involves the step of forming the horizontal injection fractures 38 from individual injection well bores 30 in rows 60, 62 and 64, and forming the horizontal production fractures 51 from individual production well bores 50 in rows 61 and 63. The injection and production fractures are formed so that they overlap with each other, similar to that described with reference to the process described with respect to FIGS. 1–4. However, they are vertically positioned at the locations as described above to maximize the recovery of hydrocarbons from the reservoir during flooding.

In summary, during formation of the fractures, the process involves the step of selectively positioning pairs of overlapping injection and production fractures, that would overlap with an impermeable layer such as 112, 112' or 112", vertically at one side of such layer in the reservoir, and selectively positioning other pairs of overlapping injection and production fractures, with the injection fracture thereof substantially at the bottom or lower limit of the reservoir and the production fracture thereof substantially at the top or upper limit of the reservoir at the respective well bore.

During block 159 of FIG. 6, the process involves flooding the hydrocarbons from the reservoir, from the injection to the overlapping production fractures, by applying a flood, identical to that discussed above, with respect to the embodiment of FIGS. 1–4.

Consider now the method in more detail. In order to maximize the recovery of hydrocarbons from a reservoir, it is necessary to position the fractures where one gets an appreciable recovery of hydrocarbons and, preferably, the largest quantity of hydrocarbons out of the reservoir.

To do this, the "characteristics of the reservoir" at each well and in relation to the other surrounding wells, must be considered and will now be discussed.

Low permeable, including impermeable layers are often found in reservoirs. Such layers may be composed of one or more layers of shale, fine grained material or heavily cemented sand. These low permeable layers tend to interfere with the flow of the hydrocarbons in the reservoir during the fluid flood between the injection and production fractures, if the layer has a horizontal dimension approximately the same as the well spacing and is located between the fractures.

Accordingly, to determine where to vertically position the fractures, preferably each well bore (at each well) is drilled all the way through the reservoir and preferably, a few feet into the shale at the lower limit of the reservoir and is scanned clear through the reservoir to locate on the upper limit and the lower limit of the reservoir and any impermeable or low permeable layers, which would inhibit the free flow of the flood between fractures.

The location of the fractures in relationship to low permeable layers must take into account the following: the overall thickness from top to bottom of the reservoir sands, the horizontal and vertical position of any low permeable layers, the horizontal extent of the low permeable layers, possible sand sequences and the types of such sands, hydrocarbon saturation porosity and permeability of the sands, ease with which the hydrocarbons can be flooded and moved through the sands and the relation of each of the above to the fracture of the well in question and the characteristics of the surrounding wells to the one in question. Based on these characteristics, an estimate is made by a geologist or the like as to the vertical location of the fractures that will yield the maximum hydrocarbons from the reservoir and the fractures are located there.

Consideration needs to be given to the effect of positioning each fracture on all of the fractures that overlap that fracture, because maximizing the recovery of hydrocarbons between one pair of overlapping fractures may cause a fracture to be vertically positioned so as to substantially reduce the recovery in the reservoir at another pair of fractures.

Also, one or more overlapping fractures are omitted if the recovery of hydrocarbons would not be significant enough to warrant a fracture or if it would require placing another fracture at an undesirable vertical position.

Consider now how the scanning process is conducted. Several methods are employed for scanning the reservoir at each well bore. The preferred method is to core each well bore all the way through the reservoir as it is being drilled and analyze the core samples for hydrocarbon saturation content, permeability, porosity and presence of low permeable layers or streaks. The well bores are also logged, using electric logs well known in the art, to determine characteristics of the reservoir sands all the way through the reservoir, and these characteristics, at various vertical levels, are correlated with the results from the core at the same vertical level to determine or at least make the best estimate of the actual "characteristics of the well" at each well bore as discussed above. This process is sometimes called calibrating the log.

In summary, the purpose of drilling and scanning all the way through the reservoir at each of the injection and production wells, is to allow measurements to be made of and evaluation of the measurements of the reservoir at each well. Based on the measurements and evaluation, the characteristics of the reservoir at each well can be estimated, which would effect the result of the flood process and, thereby, allow the injection and production wells to be located at the optimum vertical location in the reservoir. The optimum location is with respect to the upper and lower limits of the reservoir itself and with respect to neighboring overlapping wells. It should be apparent that it is not always possible to locate all of the fractures in a reservoir at the optimum location with respect to the overlapping fractures. However, it does allow the selection of the best comprise in fracture location with respect to the surrounding reservoir and overlapping fracture pattern, in those reservoirs that show variations in reservoir characteristics.

During the scanning operation, it is generally always desirable to log each well bore. However, coring may be omitted in selected wells if it is felt that enough information is known about the reservoir at that location It is desirable to omit coring where possible, because of the additional expense and time involved in cutting and analyzing the core.

With reference to FIG. 11, it will be seen that two injection well bores, in each row on opposite sides of each production well, are located on opposite sides of the well bore of the production well, along the respective row. Additionally, the injection wells are preferably located at the four corners of a square as depicted at 166, 167, 168 and 170 with the corresponding production well at the enter of the square. This allows maximum overlap between the production fracture and each of the overlapping injection fractures in most cases.

Figure 13:
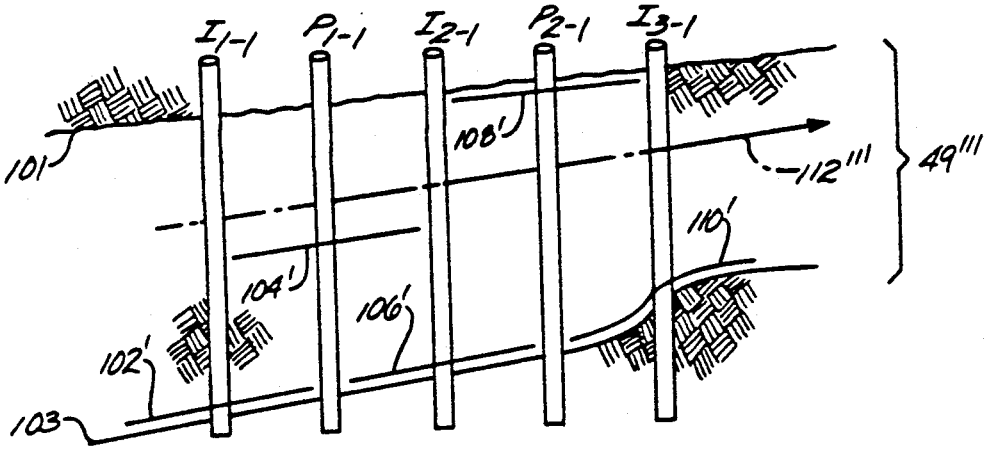
FIG. 13 is a cross-sectional review similar to FIG. 8, 10 and 12 where the upper and lower limit and the impermeable layers are at an angle with respect to horizontal.

Referring to FIG. 13, it should be noted that the upper limit 101''' and lower limit 103''' of a reservoir, such as 49''', may not be completely horizontal, but may be inclined, as depicted in FIG. 13. Additionally, the geological formation, including the stresses in the formation, may be such that the horizontal fractures will not be completely horizontal but may be slightly inclined as depicted at 102', 104', 106', 108' and 110'. Additionally, the horizontal fracture may even, undulate as indicated at 110'. The impermeable or low permeable layer 112''' may also be inclined as depicted in FIG. 13.

As in all cased wells that are to be fractured, care should be taken to insure a good cement bond with the formation and with the pipe casing using techniques well known in the art, and should extend from top to bottom in the well.

As discussed above, the rows of production and the injector wells are spaced about 283 feet apart and further the maximum expected vertical thickness of a reservoir is about 50 feet. Also, the maximum radius of a production fracture is in the order of 235 to 250 feet and the maximum radius of an injection fracture is in the order of 265 to 285 feet (i.e., a ratio of 235 to 250 divided by 265 to b 285).

Figure 14:
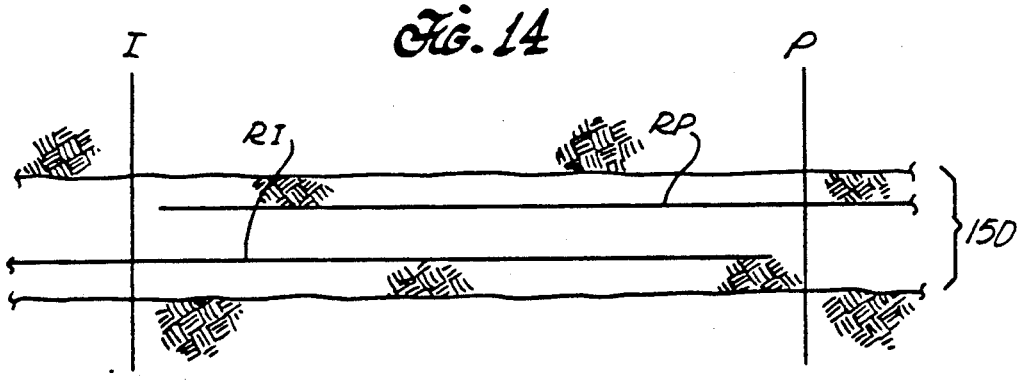
FIG. 14 is a cross-sectional view of the wells and formation with the thickness of the reservoir and the radius of the fracture draws approximately to scale for a 2½ acre spacing per well.
Figure 15:
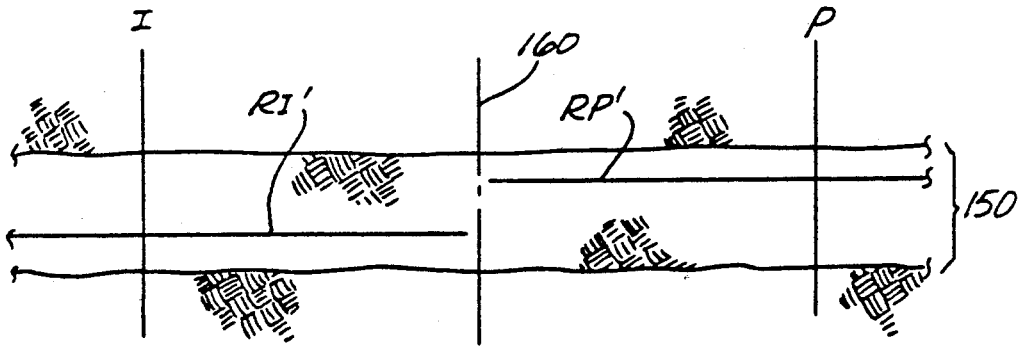
FIG. 15 is a cross-sectional view similar to FIG. 14 with the radius of the fracture such that they do not overlap.

The expected thickness of each of the horizontal fractures is in the order of 0.05 to 0.2 inches. FIG. 14 depicts a cross-sectional view of the wells and reservoirs, similar to FIGS. 2, 7, 8, 10, 12 and 13, but showing the reservoir thickness 150, the radius RP of the production well and the radius IP of the injection fractures approximately to scale. It is also contemplated that enhanced results may also be achieved, even though the fractures do not overlap, if the outer perimeter of the fractures of an adjacent pair of injection and productions wells, extend out to approximately the same horizontal positions between the wells as indicated at 160 in FIG. 15. The diameters of the injection and production fractures need not be the same. However, the large radius of the fractures and the fact that they extend out to approximately the same horizontal position between their respective well bores can be used to achieve a substantially vertical flood between horizontal fractures, i.e., a plate to plate flood. If the outer perimeters do not extend out to approximately the same position between the well bores, the flood will turn into a flood horizontally across the reservoir and will not achieve the enhanced results achieved with the present invention.

Accordingly, the foregoing description should not be read as pertaining only to the precise structures and techniques described, but rather should be read consistent with, and as support for, the following claims, which are to have their fullest fair scope.

What is claimed is:

1. In a fluid flood process for enhancing the secondary recovery of hydrocarbons from a hydrocarbon permeable and hydrocarbon bearing reservoir using recovery wells each adjacent one or more injection wells, each well comprising a well bore, and wherein there is (i) a horizontal injection fracture extending substantially horizontally from the well bore of each of selected injection wells and (ii) a horizontal recovery fracture extending substantially horizontally from the well bore of each of selected recovery wells and vertically displaced from and overlapping with the injection fracture of an adjacent injection well, each such injection fracture and an overlapping recovery fracture forming an overlapping pair, the improvement comprising the steps of:

a) scanning substantially all the way through the reservoir at each of said recovery wells and at each of the respective adjacent injection wells and locating, at each such well, i) an upper limit and a lower limit of the reservoir, and ii) any low permeable layer in the reservoir that would extend substantially continuously and horizontally into overlapping relation with the position for more than one pair of overlapping recovery and injection fractures so as to substantially impede the flow of a fluid flood through such layer between any such overlapping fractures, b) selectively positioning a pair of overlapping injection and recovery fractures, that would overlap with any such layer vertically at one side of such layer in the reservoir, and c) selectively positioning another pair of overlapping injection and recovery fractures with one fracture thereof adjacent the lower limit and the other fracture thereof adjacent the upper limit of the reservoir at he respective well so as to enable the recovery of hydrocarbons to be maximized in the reservoir during such fluid flood between overlapping injection and recovery fractures. .

2. The fluid flood process of claim 1 comprising the step of overlapping a plurality of said injection fractures with at least one recovery fracture.

3. The fluid flood process of claim 1 comprising the step of selectively omitting a fracture of a pair when any said layer would substantially overlap with such fracture.

4. The fluid flood process of claim 1 comprising the step of positioning said recovery fractures, which are recited as being positioned adjacent the upper limit of the reservoir, below the upper limit of the reservoir at the respective recovery well and positioning said injection fractures, which are recited as being positioned adjacent the lower limit of the reservoir, above the lower limit of the reservoir at the respective injection well.

5. The fluid flood process of claim 1 comprising the step of locating the well bores of a plurality of said recovery wells in a row substantially parallel with the azimuth of a vertical fracture in said reservoir and locating the well bores of the injection fractures in different rows substantially parallel with said azimuth.

6. The fluid flood process of claim 5 comprising the step of positioning two injection well bores, which are in each of two rows of injection well bores located on opposite sides of a row of recovery well bores, on opposite sides of an individual recovery well bore in such row of recovery well bores.

7. The fluid flood process of claim 6 comprising the step of positioning individual recovery well bores substantially equal distance from the injection well bores and extending the recovery fracture for the individual recovery well bores out adjacent to but not intersecting a plane parallel with the azimuth and passing through the injection well bores.

8. In a fluid flood process for enhancing the secondary recovery of hydrocarbons from a reservoir using fluid injection wells and hydrocarbons recovery wells, each well having a well bore, including the steps of (i) establishing a horizontal injection fracture extending substantially horizontally from each of plural injection well bores in said reservoir and; (ii) (ii) establishing an individual horizontal recovery fracture, in said reservoir, extending substantially horizontally from each of plural recovery well bores and vertically displaced from and overlapping in said reservoir with at least one such injection fracture from an adjacent one of such injection well bores, the improvement comprising the steps of:

determining the azimuth of a vertical component of a fracture for said reservoir; and disposing said recovery wells in at least one row which substantially parallel with said azimuth.

9. The process of claim 8 comprising the step of disposing the injection wells in at least one row substantially parallel with said azimuth.

10. The method of claim 9 comprising the step of disposing said row of recovery wells between and offset from two adjacent said rows of injection wells.

11. The method of claim 10 comprising the step of locating the recovery well bores in said row of recovery wells between two adjacent injection well bores in each of the adjacent rows of injection wells.

12. The process of claim 11 comprising the step of forming each said recovery fracture with a horizontal outer perimeter that overlaps with an ad fracture but is short of intersecting a substantially vertical plane passing through the well bores of any row of injection wells.

13. The process of claim 12 comprising the step of positioning each one of a plurality of the recovery well bores substantially equal distance from and between the closest two injection well bores in each of the adjacent rows of injection well bores.

14. The process of claim 8 wherein the step of determining the azimuth of the vertical component comprises the step of determining such azimuth during establishing at least one of said injection or recovery fractures 15. The process of claim 8 comprising the step of propping the fractures with number 12/20 or larger mesh sand.

16. The process of claim 8 comprising the step of selecting, for the reservoir, a reservoir that is less than about 1200 feet below the surface of the earth.

17. The process of claim 8 comprising the step of forming said injection fractures with substantially disk shapes, each having a radius of at least 265 to 285 feet.

18. The process of claim 8 comprising the step of forming said recovery fractures having substantially disk shapes, each having a radius of at least 235 to 250 feet.

19. The process of claim 8 comprising the step of forming at least some of the horizontal injection fractures with a vertical component in the reservoir.

20. The process of claim 8 comprising the step of applying a vertical fluid flood between the overlapping injection fractures and recovery fractures.

21. In a well system for enhancing the secondary recovery of hydrocarbons from a hydrocarbon permeable and hydrocarbon bearing reservoir using a fluid flood through plural recovery wells of each adjacent one or more injection wells, each well comprising a well bore, and wherein there is (i) a horizontal injection fracture extending substantially horizontally from the well bore of each of selected injection well bores and (ii) a horizontal recovery fracture extending substantially horizontally from the well bore of each of selected recovery wells and vertically displaced from and overlapping with the injection fracture of an adjacent injection fluid flood process of claim 6 comprising the step of positioning individual recovery well bores substantially e continuously and horizontally into overlapping relation with the position for more than one pair of overlapping recovery and injection fractures so as to substantially impede the flow of a fluid flood through such layer between any such overlapping fractures, the improvement comprising a) at least one pair of overlapping injection and recovery fractures, that would overlap with any such layer being positioned vertically at one side of such layer in the reservoir, and b) at least one other pair of overlapping injection and recovery fractures being positioned with one fracture thereof adjacent the lower limit and the other fracture thereof adjacent the upper limit of the reservoir at the respective well so as to enable the recovery of hydrocarbons to be maximized in the reservoir during such fluid flood between overlapping injection and recovery fractures.

22. In the well system of claim 21 wherein some injection fractures each overlap with recovery fractures for plural recovery wells.

23. In the well system of claim 21 wherein one fracture from a pair of fractures that would substantially overlap with such layer is omitted.

24. In the well system of claim 21 wherein said recovery fractures, which are recited as being positioned adjacent the upper limit of the reservoir, are positioned below the upper limit of the reservoir at the respective recovery well bore and said injection fractures, which are recited as being positioned adjacent the lower limit of the reservoir, are positioned above the lower limit of the reservoir at the respective injection well.

25. In the well system of claim 21 wherein the well bores of a plurality of said recovery wells are positioned in a row substantially parallel with the azimuth of a vertical fracture in said reservoir and the well bores of the injection fractures are positioned in different rows substantially parallel with said azimuth.

26. In the well system of claim 25 wherein two injection well bores, which are in each of two rows on opposite sides of a row of recovery well bores, are positioned on opposite sides of an individual recovery well bores in such row of recovery well bores.

27. In the well system of claim 26 wherein the individual recovery well bore is positioned substantially equal distance from the two adjacent injection well bores and the recovery fracture for the individual recovery well bore extends out adjacent to but not intersecting with a plane parallel with the azimuth and passing through the injection well bores of each of the adjacent rows of injection well bores.

28. In a well system for enhancing the secondary recovery of hydrocarbons from a reservoir involving fluid injection wells and hydrocarbon recovery wells, each well having a well bore and wherein there is a horizontal injection fracture extending substantially horizontally from each of plural injection well bores in said reservoir and a horizontal recovery fracture in said reservoir extending substantially horizontally from each of plural recovery well bores vertically displaced from and overlapping with at least one injection fracture of an adjacent injection well bore, the improvement comprising:

disposing said recovery wells in at least one row which is substantially parallel with the azimuth of a vertical component of a fracture in said reservoir.

29. In the well system of claim 28, wherein the injection wells are disposed in the at least one row substantially parallel with said azimuth.

30. In the well system of claim 29 wherein said at least one row of recovery wells is positioned between and offset from two adjacent ones of said at least one row of injection wells.

31. In the well system of claim 30 wherein the recovery well bores in said at least one row of recovery wells is positioned between two adjacent injection well bores in each of the adjacent rows of injection wells.

32. In the well system of claim 31 wherein each said recovery fracture has a horizontal outer perimeter that overlaps with adjacent injection fractures but is short of intersecting a substantially vertical plane that substantially passes through the wells bores of the adjacent rows of injection wells.

33. In the well system of claim 32 wherein each of a plurality of the recover well bores is positioned substantially equal distance from and between the closest two injection well bores in each of the adjacent rows of injection well bores.

34. In the well system of claim 28 wherein the vertical component comprises a vertical component of one of said injection and recovery fractures.

35. In the well system of claim 28 wherein the fractures are propped with number 12/20 or larger mesh sand.

36. In the well system of claim 28 wherein the reservoir is less than about 1200 feet below the surface of earth.

37. In the well system of claim 28 wherein the injection fractures have substantially disk shapes each having a radius of at least 265 to 285 feet.

38. In the well system of claim 28 wherein the recovery fractures have substantially disk shapes each having a radius of at least 235 to 250 feet.

39. In the well system of claim 28 comprising a vertical fluid flood between the overlapping injection and recovery fractures.

40. In a flooding process for enhancing the secondary recovery of hydrocarbons from a hydrocarbon permeable and hydrocarbon bearing reservoir using recovery wells one or more injection wells, each well comprising a well bore, and wherein there is (i) a horizontal injection fracture extending substantially horizontally from each of individual such injection well bores and (ii) a horizontal recovery fracture extending substantially horizontally from each of individual such recovery well bores and vertically displaced from an adjacent injection well between which a fluid flood is passed, each such recovery fracture and an adjacent injection fracture forming an adjacent pair, the improvement comprising the steps of:

a) scanning substantially all the way through the reservoir a&: each of said recovery wells and at each of said injection wells and locating, at each such well, i) an upper limit and a lower limit of the reservoir, and ii) any low permeable layer in the reservoir that would extend substantially continuously and horizontally into overlapping relation with the position for at least one fracture of more than one pair of recover and injection fractures so as to substantially impede the flow of such a fluid flood through such layer and into or out of any fracture overlapping therewith, b) selectively positioning a pair of adjacent injection and recovery fractures, in which at least one fracture thereof would overlap with any such layer, vertically at one side of such layer in the reservoir, and c) selectively positioning another such pair of adjacent injection and recovery fractures with the one fracture thereof adjacent the lower limit and the other fracture thereof adjacent the upper limit of the reservoir at the respective well so as to enable the recovery of hydrocarbons to be maximized in the reservoir during such fluid flood between adjacent injection and recovery fractures.

41. In the fluid flood process of claim 40 wherein the injection and recovery fractures of each pair are formed with an outer perimeter that extends to at least substantially the same horizontal position between the respective well bores from which the pair of fractures extend.

42. The fluid flood process of claim 40 comprising the step of overlapping the fractures in at least one of the pairs.

43. The fluid flood process of claim 40 comprising the step of selectively omitting a fracture of a pair when any said layer would substantially overlap with such fracture.

44. The fluid flood process of claim 40 comprising the step of positioning said recovery fractures, which are recited as being positioned adjacent the upper limit of the reservoir, below the upper limit of the reservoir at the respective recovery well and positioning said injection fractures, which are recited as being positioned adjacent the lower limit of the reservoir, above the lower limit of the reservoir at the respective injection well.

45. The fluid flood process of claim 40 comprising the step of locating the well bores of a plurality of said recovery wells in a row substantially parallel with the azimuth of a vertical fracture in said reservoir and locating the well bores of the injection fractures in different rows substantially parallel with said azimuth.

46. The fluid flood process of claim 45 comprising the step of positioning the two injection well bores, which are in each of two rows on opposite sides of a row of recovery well bores, on opposite sides of individual recovery well bores in such row of recovery well bores.

47. The fluid flood process of claim 47 comprising the step of positioning individual recovery well bores substantially equal distance from the adjacent injection well bores and extending the recovery fracture for the individual recovery well bores out adjacent to but not intersecting a plane parallel with the azimuth and passing through the injection well bores.

48. In a fluid flood process for enhancing the secondary recovery of hydrocarbons from a reservoir using fluid injection wells and hydrocarbon recovery wells, each well having a well bore, including the steps of (i) establishing a horizontal injection fracture extending substantially horizontally from each of plural injection well bores in said reservoir and; (ii) establishing a horizontal recovery fracture, in said reservoir, extending substantially horizontally from each of plural recovery well bores and vertically displaced from at least one injection fracture of an adjacent injection well bore, the improvement comprising the steps of:

determining the azimuth of a vertical component of a fracture for said reservoir; and disposing said recovery wells in at least one row which is substantially parallel with said azimuth.

49. The method of claim 48 wherein the injection and recovery fractures of each of the adjacent well bores each have an outer perimeter that extends to at least substantially the same horizontal position between the respective adjacent well bores.

50. The method of claim 48 comprising the step of placing at lease some injection fractures adjacent a lower limit and at least some recovery fractures adjacent on upper limit of the reservoir.

51. The method of claim 48 comprising the step of disposing the injection wells in at least one row substantially parallel with said azimuth.

52. The method of claim 51 comprising the step of disposing said row of recovery wells between and offset from two adjacent said rows of injection wells.

53. The method of claim 52 comprising the step of locating the recovery well bores in said row of recovery wells between two adjacent injection well bores in each of the adjacent rows of injection wells.

54. The method of claim 53 comprising the step of forming each said recovery fracture with a horizontal outer perimeter that overlaps with an adjacent injection fracture but is short of intersecting a substantially vertical plane passing through the well bores of any row of injection wells.

55. The method of claim 54 comprising the step of positioning each one of a plurality of the recovery well bores substantially equal distance from and between the closest two injection well bores in each of the adjacent rows of injection well bores.

56. The process of claim 48 wherein the step of determining the azimuth of the vertical component comprises the step of determining such azimuth during establishing at least one of said injection and recovery fractures.

57. The process of claim 48 comprising the step of propping the fractures with number 12/20 or larger mesh sand.

58. The process of claim 48 comprising the step of selecting, for the reservoir, a reservoir that is less than about 1200 feet below the surface of the earth.

59. The process of claim 48 comprising the step of forming said injection fractures with substantially disk shapes, each having a radius of at least 265 to 285 feet.

60. The process of claim 48 comprising the step of forming said recovery fractures having substantially disk shapes, each having a radius of at least 235 to 250 feet.

61. The process of claim 48 comprising the step of forming at least some of the horizontal injection fractures with a vertical component in the reservoir.

62. The process of claim 48 comprising the step of applying a vertical fluid flood between the overlapping injection fractures and recovery fractures.

63. In a well system for enhancing the secondary recovery of hydrocarbons from a hydrocarbon permeable and hydrocarbon bearing reservoir using a fluid flood through plural recovery wells each adjacent one or more injection wells, each well comprising a well bore, and wherein there is (i) a horizontal injection fracture extending substantially horizontally from the well bore of each of selected injection well bores and (ii) a horizontal recovery fracture extending substantially horizontally from the well bore of each of selected recovery wells and vertically displaced from the injection fracture of an adjacent injection well, each such injection fracture and a recovery fracture of an adjacent well forming a pair, and at some wells a low permeable layer in the reservoir that extends substantially continuously and horizontally into overlapping relation with the position for more than one pair of fractures so as to substantially impede the flow of a fluid flood through such layer between fractures of adjacent wells, the improvement comprising a) at least one pair of injection and recovery fractures, that would overlap with any such layer being positioned vertically at one side of such layer in the reservoir, and b) another such pair of injection and recovery fractures being positioned with the injection fracture thereof adjacent the lower limit and the recovery fracture thereof adjacent the upper limit of the reservoir at the respective well so as to enable the recovery of hydrocarbons to be maximized in the reservoir during such fluid flood between overlapping injection and recovery fractures.

64. In the well system of claim 63 wherein some injection fractures overlap with recovery fractures 65. In the well system of claim 63 wherein one fracture from a pair of fractures that would substantially overlap with such layer being omitted.

66. In the well system of claim 63 wherein said recovery fractures, which are recited as being positioned adjacent the upper limit of the reservoir, are positioned below the upper limit of the reservoir at the respective recovery well bore and said injection fractures, which are recited as being positioned adjacent the lower limit of the reservoir, are positioned above the lower limit of the reservoir at the respective injection well.

67. In the well system of claim 63 wherein the well bores of a plurality of said recovery wells are positioned in a row substantially parallel with the azimuth of a vertical fracture in said reservoir and the well bores of the injection fractures are positioned in different rows substantially parallel with said azimuth 68. In the well system of claim 67 the two injection well bores, which are adjacent and in each of two rows on opposite sides of a row of recovery well bores, are positioned on opposite sides of individual recovery well bores in such row of recovery well bores.

69. In the well system of claim 68 wherein the individual recovery well bores are positioned substantially equal distance from the adjacent injection well bores and the recovery fracture for the individual recovery well bores extend out adjacent to but not intersecting with a separate plane parallel with the azimuth and passing through the injection well bores in each of the adjacent rows.

70. In a well system for enhancing the secondary recovery of hydrocarbons from a reservoir comprising fluid injection wells and hydrocarbon recovery wells, each well having a well bore and wherein there is a horizontal injection fracture extending substantially horizontally from each of plural injection well bores in said reservoir and a horizontal recovery fracture in said reservoir extending substantially horizontally from each of plural recovery well bores and being vertically displaced from and adjacent at least one injection fracture of an adjacent injection well bore, the improvement comprising:

disposing said recovery wells in at least one row which is substantially parallel with the azimuth or a vertical component of a fracture in said reservoir.

71. In the well system of claim 70, wherein the injection wells are disposed in at least one row substantially parallel with said azimuth.

72. In the well system of claim 71 wherein said row of recovery wells is positioned between two adjacent rows of said injection wells which are substantially parallel with said azimuth.

73. In the well system of claim 72 wherein each of a plurality of the recovery well bores in said row of recovery wells is positioned between two adjacent injection well bores in each of the adjacent rows of injection wells.

74. In the well system of claim 73 wherein each of at least some of the overlapping recovery and injection fractures do not intersect a vertical plane that substantially passes through the well bores of any adjacent row of injection wells.

75. In the well system of claim 74 wherein each of a plurality of the recovery well bores are each substantially equal distance from and between the closest two injection well bores in each of the adjacent rows of injection well bores.

76. In the well system of claim 70 wherein the vertical component comprises a vertical fracture of one of said injection or recovery fractures.

77. In the well system of claim 70 wherein the fractures are propped with number 12/20 or larger mesh sand.

78. In the well system of claim 70 wherein the reservoir is less than about 1200 feet below the surface of earth.

79. In the well system of claim, 70 wherein the injection fractures have substantially disk shapes each having a radius of at least 265 to 285 feet.

80. In the well system of claim 70 wherein the recovery fractures have substantially disk shapes each having a radius of at least 235 to 250 feet.

81. In the well system of claim 70 comprising a vertical fluid flood between the overlapping injection fractures and recovery fractures and the recovery wells.

82. The fluid flood process of claim 1 wherein the step of placing one fracture of a pair adjacent the lower limit and the other fracture of the pair adjacent upper limit comprises the step of placing the injection fracture adjacent the lower limit and the recovery fracture adjacent the upper limit of the reservoir.

83. The method of claim 8 comprising the step of placing at least some injection fractures adjacent the lower limit and at least some recovery fractures adjacent an upper limit of the reservoir.

84. The process of claim 8 comprising the step of forming at least some of said overlapping injection and recovery fractures having substantially disk shapes and with the ratio of the radius of at least one of such recovery fractures to the radius of at least one of such overlapping injection fractures being about 235 to 250 divided by 265 to 285.

85. In the well system of claim 28 wherein at least some of the overlapping injection and recovery fractures have substantially disk shapes, and the ratio of the radius of at least one of such recovery fractures to the radius of at least one such overlapping injection fractures is about 235 to 250 divided by 265 to 285.

86. The process of claim 48 comprising the step of forming at least some of said injection and recovery fractures having substantially disk shapes and with the radio of the radius of at least one of such recovery fractures to the radius of at least one of such overlapping injection fractures is about 235 to 250 divided by 265 to 285.

87. In the well system of claim 70 wherein at least some of the overlapping injection and recovery fractures have substantially disk shapes and the ratio of the radius of at least one of such recovery fractures to the radius of at least one of such overlapping injection fractures is about 235 to 250 divided by 265 to 285.

* * * * *

UNITED STATES PATENT AND TRADEMARK OFFICE

CERTIFICATE OF CORRECTION

PATENT NO. : 5,025,859

DATED : June 25, 1991

INVENTOR(S) : Merle E. Hanson; Lewis D. Thorson

It is certified that error appears in the above-identified patent and that said Letters Patent is hereby corrected as shown below:

On title page, item

[63] Related U.S. Application Data, change "Mar. 31, 1987" to -- Mar. 31, 1989 --.

Column 1, line 10, after "186,046," change "Filed" to -- filed --.
Column 1, line 18, change "particular" to -- particularly --.

Column 2, line 41, change "horizontal" to -- horizontally --.

Column 4, line 6, change "fracture" to -- fractures --.
Column 4, line 45, after "wells" change "are" to -- is --.

Column 5, line 14, change "elevation" to -- elevational --.
Column 5, line 25, after "10" change "an" to -- and --.
Column 5, line 27, change "review" to -- view --.

Column 6, line 22, change "upward" to -- upwardly --.
Column 6, line 61, after "fracture" insert a period.
Column 6, line 67, after "disclosed" change "is" to -- in --.
Column 6, line 68, after "1963" insert a comma.

UNITED STATES PATENT AND TRADEMARK OFFICE

CERTIFICATE OF CORRECTION

PATENT NO. : 5,025,859

DATED : June 25, 1991

INVENTOR(S) : Merle E. Hanson; Lewis D. Thorson

It is certified that error appears in the above-identified patent and that said Letters Patent is hereby corrected as shown below:

Column 7, line 15, after "formation" insert a period.
Column 7, line 46, after "drilling" insert -- of --.
Column 7, line 64, after "fracture" insert a period.
Column 7, line 66, change "12 and 13" to -- I2 and I3 --.

Column 8, line 3, change "12 and 13" to -- I2 and I3 --.
Column 8, line 23, change "p1-2, p2-1" to -- P1-2, P2-1 --.
Column 8, line 33, after "50" insert a period.
Column 8, line 38, after "fractures" insert a period.
Column 8, line 68, after "fractures" insert a period.

Column 9, line 7, after "example" insert a period.
Column 9, line 28, after "boundary" insert a period.
Column 9, line 30, after "fracture" insert a period.
Column 9, line 34, after "follows" insert a colon.

Column 10, line 16, after "250" insert a period.
Column 10, line 19, change "tp" to -- to --.
Column 10, line 42, after "fracture" insert a period.
Column 10, line 50, before "bearing" insert
-- hydrocarbon --.

Column 11, line 25, change "p1-2, 12-1, 12-2, p2-1, p2-2" to
-- P1-2, I2-1, I2-2, P2-1, P2-2 --.
Column 11, line 67, change "11-2 and 12-1" to -- I1-1 and I2-1 --.

Column 12, line 23, change "p2-1" to -- P2-1 --.

UNITED STATES PATENT AND TRADEMARK OFFICE

CERTIFICATE OF CORRECTION

PATENT NO. : 5,025,859

DATED : June 25, 1991

INVENTOR(S) : Merle E. Hanson; Lewis D. Thorson

It is certified that error appears in the above-identified patent and that said Letters Patent is hereby corrected as shown below:

Col. 14, lines 13 and 14, after "best" change "comprise" to --compromise--;

Column 14, line 32, after "well at the" change "enter" to --center--;

Column 15, line 55, change "he" to -- the --.

Column 16, line 32, delete "(ii)" (second occurrence).
Column 16, line 43, after "which" insert -- is --.
Column 16, line 56, after "an" change "ad" to -- adjacent injection --.
Column 16, line 68, after "fractures" insert a period.

Column 17, lines 32-39, after "adjacent injection" delete the remainder of the paragraph down to the heading "a)" and insert therefor -- well, each such injection fracture and an overlapping recovery fracture forming an overlapping pair, and at some wells a low permeable layer in the reservoir that extends substantially continuously and horizontally into overlapping relation with the portion for more that one pair of overlapping recovery and injection fractures so as to substantially impede the flow of a fluid flood through such layer between any such overlapping fractures, the improvement comprising --.

Column 18, line 7, change "bores" to -- bore --.
Column 18, line 33, after "disposed in" delete "the".
Column 18, line 50, change "recover" to -- recovery --.

Column 19, line 19, change "a&:" to -- at --.
Column 19, line 26, change "recover" to -- recovery --.

UNITED STATES PATENT AND TRADEMARK OFFICE

CERTIFICATE OF CORRECTION

PATENT NO. : 5,025,859

DATED : June 25, 1991

INVENTOR(S) : Merle E. Hanson; Lewis D. Thorson

It is certified that error appears in the above-identified patent and that said Letters Patent is hereby corrected as shown below:

Column 20, line 6, change "47" to -- 46 --.
Column 20, line 36, change "lease" to -- least --.
Column 20, line 38, before "upper" change "on" to -- an --.

Column 21, line 68, after "azimuth" insert a period.

Column 22, line 60, delete the comma after "claim".

Column 24, line 9, change "radio" to -- ratio --.

Signed and Sealed this

Fifth Day of July, 1994

Bruce Lehman

*Attest:*

BRUCE LEHMAN

*Attesting Officer*

*Commissioner of Patents and Trademarks*